US011767186B2

(12) United States Patent
Fukuma

(10) Patent No.: US 11,767,186 B2
(45) Date of Patent: Sep. 26, 2023

(54) SHEET TRANSPORT DEVICE INCLUDING GEAR TRAIN HAVING MOVABLE GEAR WITH HELICAL GEAR, AND LEAF SPRING THAT BUFFERS MOVEMENT OF MOVABLE GEAR IN ONE DIRECTION, AND IMAGE FORMING APPARATUS

(71) Applicant: KYOCERA Document Solutions Inc., Osaka (JP)

(72) Inventor: Nobuhiro Fukuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 138 days.

(21) Appl. No.: 17/579,484

(22) Filed: Jan. 19, 2022

(65) Prior Publication Data

US 2022/0234851 A1 Jul. 28, 2022

(30) Foreign Application Priority Data

Jan. 28, 2021 (JP) ..... 2021-011685

(51) Int. Cl.
*B65H 5/06* (2006.01)

(52) U.S. Cl.
CPC ..... *B65H 5/062* (2013.01); *B65H 2403/81* (2013.01); *B65H 2601/11* (2013.01)

(58) Field of Classification Search
None
See application file for complete search history.

(56) References Cited

U.S. PATENT DOCUMENTS

2011/0233846 A1* 9/2011 Miwa ..... B65H 5/062 271/10.13
2017/0075279 A1* 3/2017 Hayakawa ..... F16H 1/20

FOREIGN PATENT DOCUMENTS

JP H07-125873 A 5/1995
JP 2006106328 A * 4/2006

* cited by examiner

*Primary Examiner* — Jennifer Bahls
(74) *Attorney, Agent, or Firm* — IP Business Solutions, LLC

(57) ABSTRACT

A sheet transport device includes a transport roller, a drive source, and a gear train. The transport roller transports a sheet. The gear train transmits rotating force from the drive source to the transport roller. The gear train includes a movable gear and a leaf spring. The movable gear is configured to move between a normal position where transmission of the rotating force to the transport roller is enabled, and a disengaged position where the transmission of the rotating force to the transport roller is interrupted, and also to move in an axial direction, and includes a helical gear that generates force to axially move in one direction, when the movable gear moves from the normal position to the disengaged position. The leaf spring buffers the movement of the movable gear in the one direction.

5 Claims, 8 Drawing Sheets

SHEET TRANSPORT DEVICE INCLUDING GEAR TRAIN HAVING MOVABLE GEAR WITH HELICAL GEAR, AND LEAF SPRING THAT BUFFERS MOVEMENT OF MOVABLE GEAR IN ONE DIRECTION, AND IMAGE FORMING APPARATUS

INCORPORATION BY REFERENCE

This application claims priority to Japanese Patent Application No. 2021-011685 filed on Jan. 28, 2021, the entire contents of which are incorporated by reference herein.

BACKGROUND

The present disclosure relates to a sheet transport device including a gear train that transmits rotating force from a motor to a transport roller that transports a sheet, and to an image forming apparatus.

Existing image forming apparatuses generally include a transport roller pair that transports recording sheets. The transport roller pair include a drive roller, and a follower roller made to rotate by the rotation of the drive roller. The drive roller is connected to a motor, via a gear train. The drive roller is made to rotate by rotating force transmitted from the motor through the gear train.

In case a paper jam occurs during an image forming operation, the sheet may remain caught by the transport roller pair. Accordingly, a technique to solve the paper jam is known, including allowing one of the gears constituting the gear train to move between a normal position, where transmission of the rotating force to the drive roller is enabled, and a disengaged position where the transmission of the rotating force to the drive roller is interrupted. When the gear is moved to the disengaged position to fix the paper jam, the drive roller can freely rotate, and therefore the jammed paper can be removed from the transport roller pair, without significant difficulty.

For example, the existing image forming apparatuses include a planetary gear mechanism (gear train) provided between the drive motor and the paper feed roller (drive roller). The planetary gear mechanism includes a sun gear, a planetary gear meshed with the sun gear, and a first-stage gear meshed with the planetary gear. When a paper jam occurs, the drive motor is made to rotate reversely for a predetermined time, to reversely rotate the sun gear and disengage the planetary gear from the first-stage gear. In this way, the existing image forming apparatuses interrupt the transmission of the rotating force, from the drive motor to the paper feed roller.

SUMMARY

The disclosure proposes further improvement of the foregoing technique.

In an aspect, the disclosure provides a sheet transport device including a transport roller, a drive source, and a gear train. The transport roller transports a sheet. The gear train transmits rotating force from the drive source to the transport roller. The gear train includes a movable gear and a leaf spring. The movable gear is configured to move between a normal position where transmission of the rotating force to the transport roller is enabled, and a disengaged position where the transmission of the rotating force to the transport roller is interrupted, and also to move in an axial direction, and includes a helical gear that generates force to axially move in one direction, when the movable gear moves from the normal position to the disengaged position. The leaf spring buffers the movement of the movable gear in the one direction.

In another aspect, the disclosure provides an image forming apparatus including the foregoing sheet transport device, and an image forming device. The image forming device forms an image on a sheet.

DETAILED DESCRIPTION

Hereafter, an image forming apparatus according to an embodiment of the disclosure will be described, with reference to the accompanying drawings.

Figure 1:
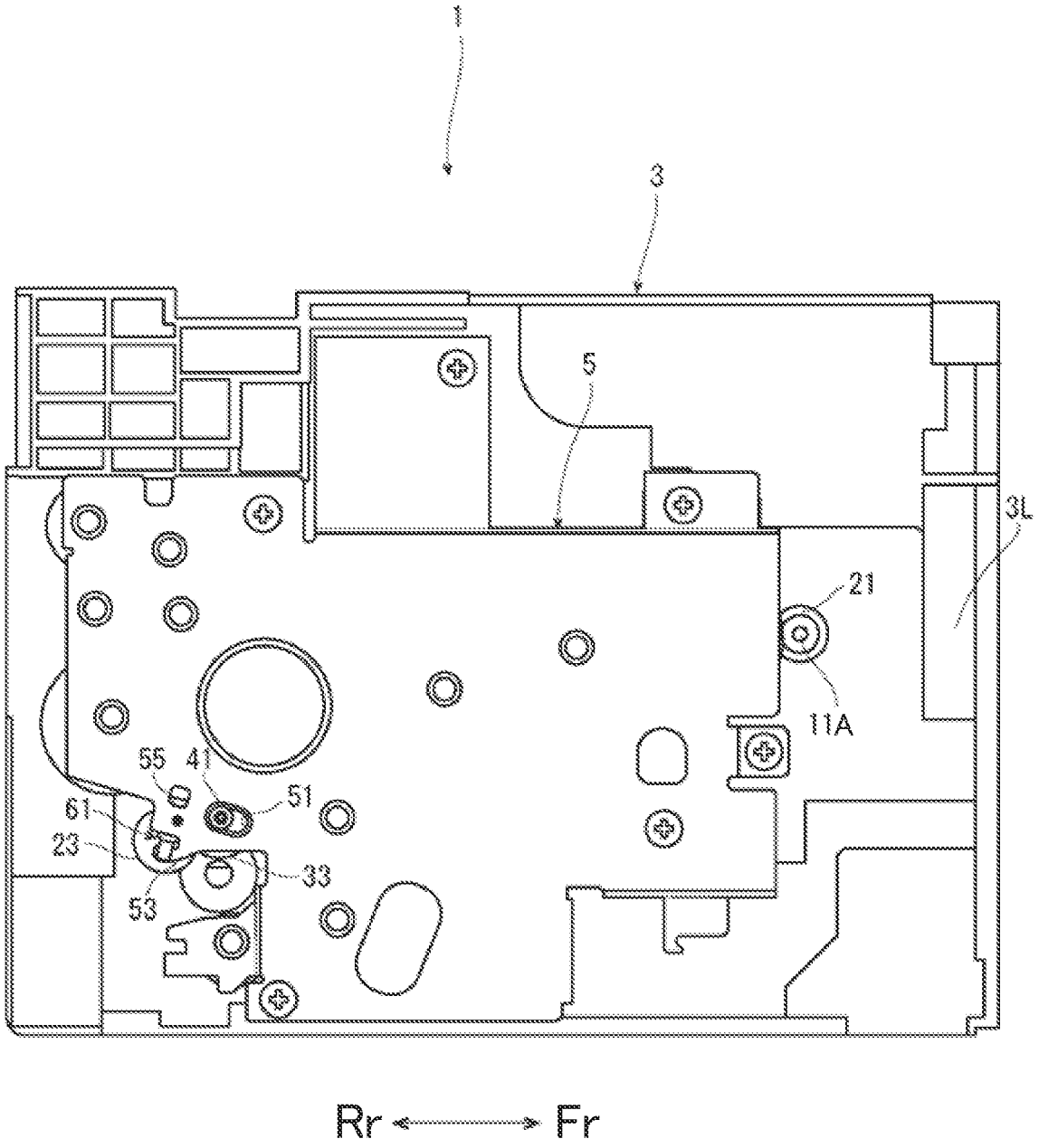
FIG. 1 is a side view showing an image forming apparatus, with its outer cover removed.
Figure 2:
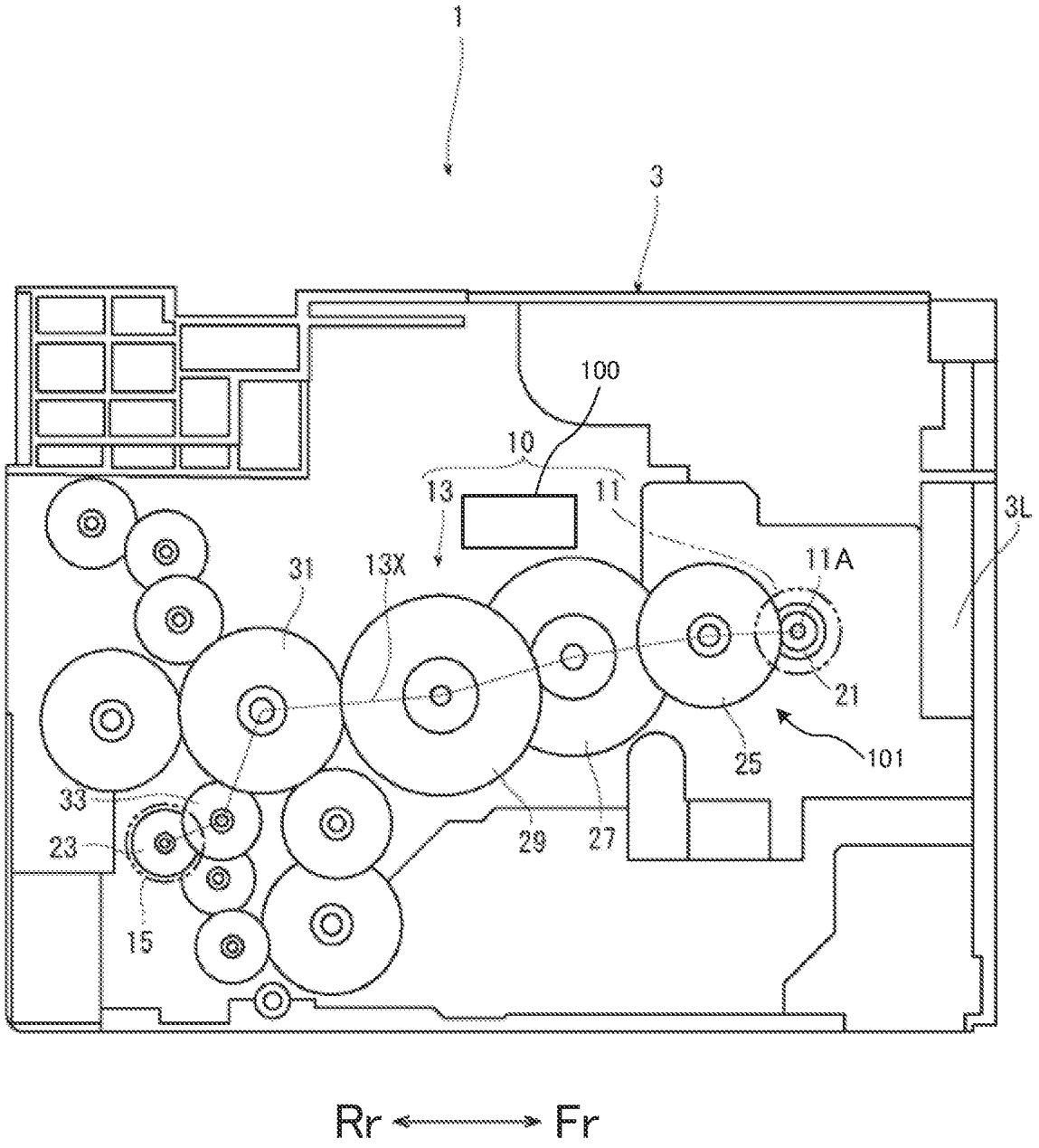
FIG. 2 is a side view showing the image forming apparatus, with its outer cover and cover plate removed.

Referring first to FIG. 1 and FIG. 2, the image forming apparatus 1 will be described. FIG. 1 is a side view showing the image forming apparatus 1, with its outer cover removed. FIG. 2 is a side view showing the image forming apparatus 1, with its outer cover and cover plate 5 removed. Reference codes Fr, Rr, L, and R in the drawings indicate the front side, the rear side, the left side, and the right side of the image forming apparatus 1, respectively.

The image forming apparatus 1 includes a casing 3 having an internal space of a generally rectangular parallelepiped shape. Inside the casing 3, a paper feeding device that feeds sheets, an image forming device 100 that forms a toner image on the sheet, a fixing device that fixes the toner image onto the sheet, and a delivery device that delivers the sheet, are accommodated. Inside the casing 3, also a transport route of the sheet is provided, from the paper feeding device to the delivery device through the image forming device 100 and the fixing device. A resist roller pair and a transport roller pair are provided, at predetermined positions on the transport route. These roller pairs serve to transport the sheet from the paper feeding device to the delivery device, along the transport route. On the upper face of the casing 3, an output tray is provided.

The paper feeding device includes a feed roller. The feed roller delivers, by rotating, the sheet placed on a paper cassette or a manual bypass tray to the transport route. The image forming device 100 includes an exposure device, a photoconductor drum, a charging device, a developing device, a cleaning device, and a toner container. The image forming device 100 forms a toner image by means of electrophotography, on the sheet delivered from the paper feeding device. The fixing device includes a heat roller and a pressure roller, and fixes the toner image onto the sheet while transporting the sheet, by causing the mentioned rollers to rotate. The delivery device includes a delivery roller pair, and delivers, by causing the delivery roller pair to rotate, the sheet on which the toner image has been fixed, to the output tray.

The plurality of rotating bodies, such as the transport roller pair, the feed roller, the heat roller, the pressure roller, and the photoconductor drum are driven to rotate by a drive mechanism 10 shown in FIG. 2. The drive mechanism 10 includes a bidirectionally rotatable, brushed DC motor 11, and a gear train 13 including drive gears fixed to the rotary shaft of the respective rotating bodies. When the rotating force of the motor 11 is transmitted to each of the plurality of rotating bodies via the gear train 13, each of the rotating bodies is made to rotate in a predetermined direction, at a predetermined rotation speed. The motor 11 according to this embodiment exemplifies the drive source in the disclosure. The plurality of rotating bodies, the drive mechanism 10, and the gear train 13 act as a sheet transport device 101 according to the disclosure.

As shown in FIG. 2, an end portion (left end portion) of an output shaft 11A of the motor 11 is penetrating through a side plate 3L (left side plate) of the casing 3. To the end portion of the output shaft 11A protruding from the side plate 3L, an output gear 21 is fixed. An end portion (left end portion) of the rotary shaft of each of the rotating bodies is also penetrating through the side plate 3L of the casing 3. To the end portion of each of the rotary shafts protruding from the side plate 3L, a drive gear is fixed. As shown in FIG. 1, most of the drive gears are covered with the cover plate 5. In other words, most of the drive gears are located in the space between the side plate 3L and the cover plate 5.

Referring to FIG. 2, a gear train 13X, provided between the motor 11 and the transport roller pair, will be described hereunder. The transport roller pair is located on the transport route, at a position between the image forming device 100 and the fixing device, and includes a transport drive roller 15 and a follower roller made to rotate by the rotation of the transport drive roller 15. In this embodiment, the transport drive roller 15 exemplifies the transport roller in the disclosure. As described above, an end portion (left end portion) of the rotary shaft of the transport drive roller 15 is penetrating through the side plate 3L of the casing 3. To the end portion of the rotary shaft protruding from the side plate 3L, a transport drive gear 23 is fixed. Here, description of the drive gears other than the gear train 13X will be skipped.

The gear train 13X includes the output gear 21, a first to fourth drive gears 25, 27, 29, and 31, a movable gear 33, and the transport drive gear 23. The output gear 21 is meshed with the first drive gear 25. The first drive gear 25 is meshed with the second drive gear 27. The second drive gear 27 is meshed with the third drive gear 29. The third drive gear 29 is meshed with the fourth drive gear 31. The fourth drive gear 31 is meshed with the transport drive gear 23, via the movable gear 33.

The movable gear 33 is set to move between a normal position where the movable gear 33 is meshed with the transport drive gear 23, and a disengaged position where the movable gear 33 is disengaged from the transport drive gear 23. When the movable gear 33 is located at the normal position, the transmission of the rotating force from the fourth drive gear 31 to the transport drive gear 23 is enabled, via the movable gear 33. When the movable gear 33 moves to the disengaged position, the transmission of the rotating force from the fourth drive gear 31 to the transport drive gear 23 is interrupted.

Now, in case a paper jam occurs while the sheet is being transported along the transport route, the transport roller pair suspends the rotation, and therefore the sheet may remain caught by the transport roller pair. Although one tries to draw out the sheet caught by the transport roller pair, it is difficult to draw out the sheet owing to the friction between the transport drive roller 15 and the sheet, because the transport drive roller 15 has stopped rotating. To fix the paper jam, therefore, the movable gear 33 is moved to the disengaged position, to interrupt the transmission of the rotating force from the motor 11 to the transport drive roller 15, so that the transport drive roller 15 is allowed to freely rotate. As result, the jammed sheet can be removed, without significant difficulty.

Figure 3:
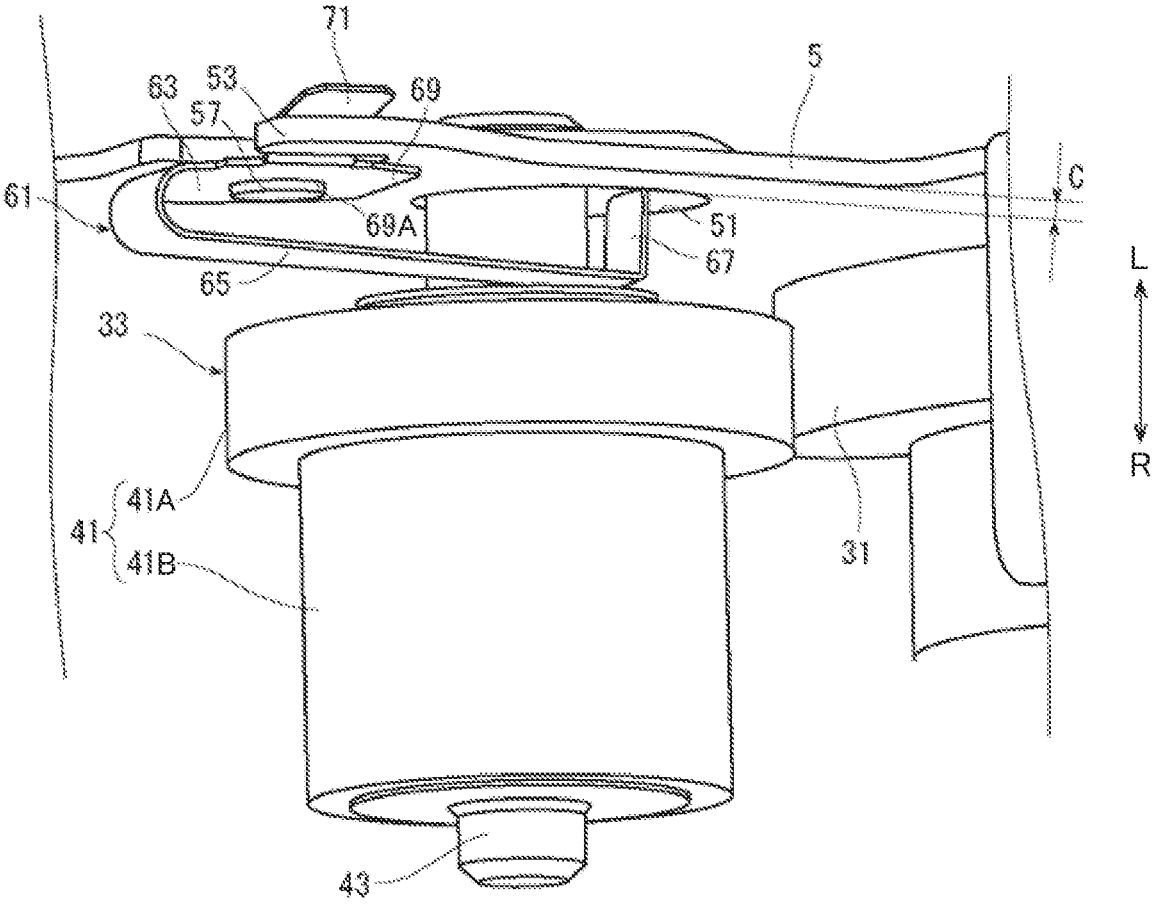
FIG. 3 is a perspective view showing a movable gear and a leaf spring.
Figure 4A:
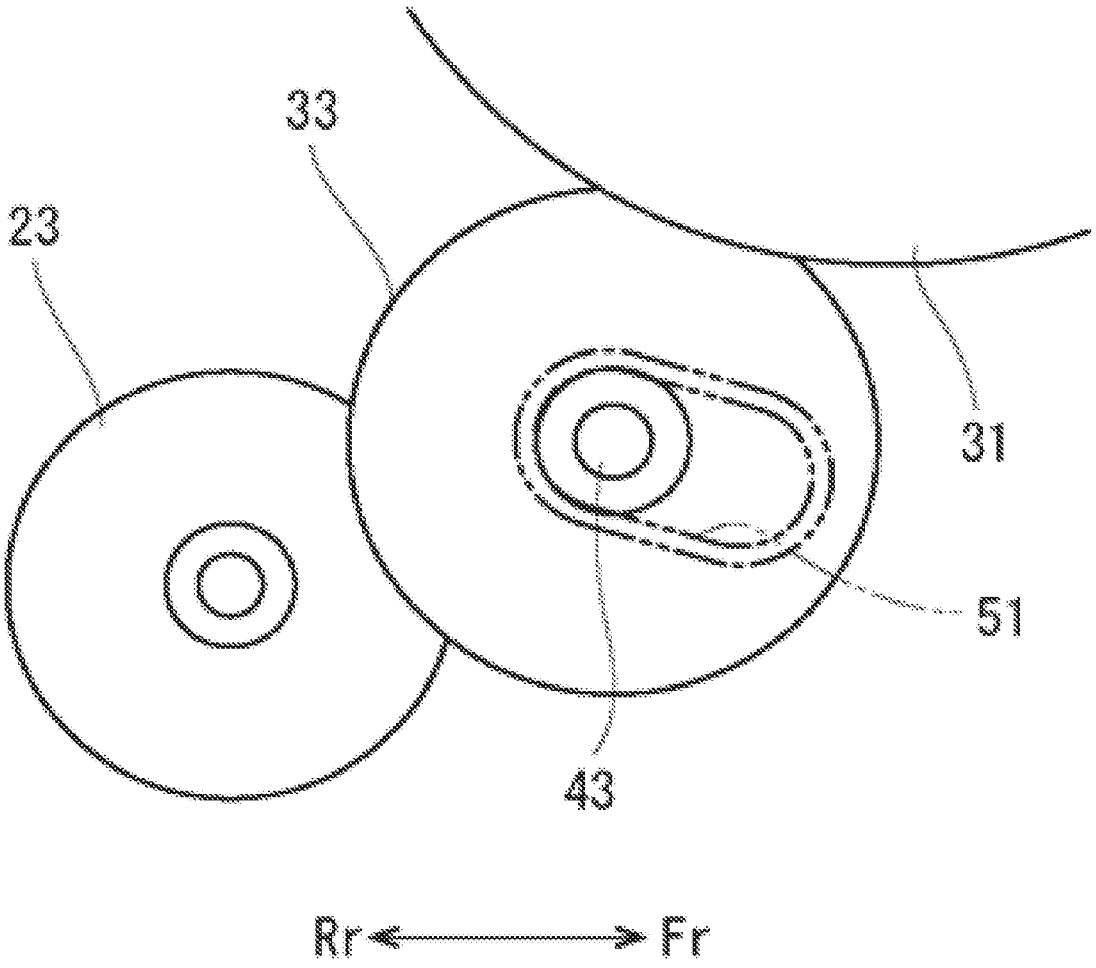
FIG. 4A is a side view of the movable gear located at a normal position.
Figure 4B:
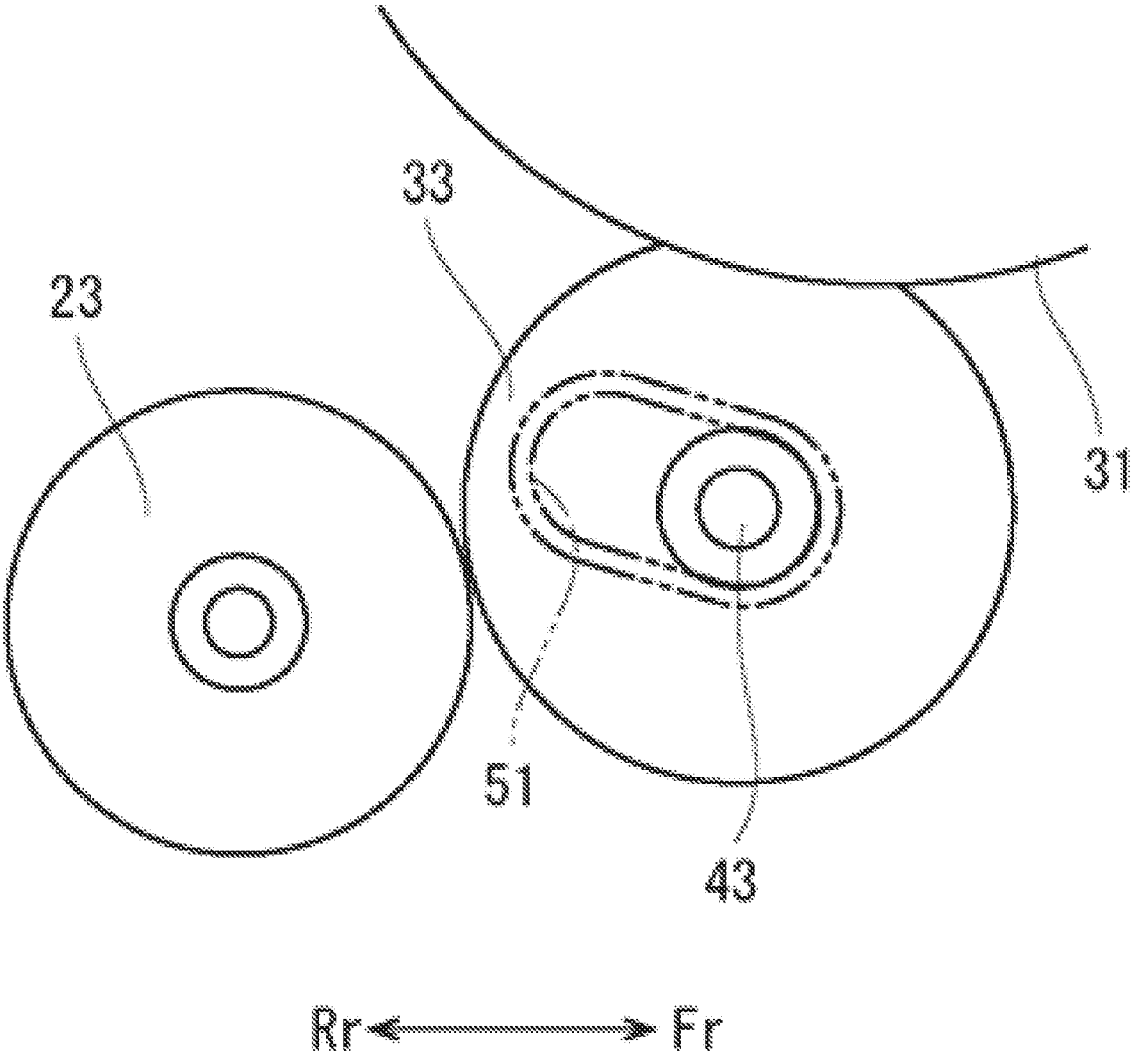
FIG. 4B is a side view of the movable gear located at a disengaged position.

The configuration of the movable gear 33 will be described, with reference to FIG. 3, FIG. 4A, and FIG. 4B. FIG. 3 is a perspective view showing the movable gear and a leaf spring. FIG. 4A and FIG. 4B illustrate the movable gear before and after the position change. In FIG. 3, the side plate 3L is not shown.

As shown in FIG. 3, the movable gear 33 includes a gear portion 41 and a rotary shaft 43. The end portions of the rotary shaft 43 are respectively supported by the side plate 3L (see FIG. 1 and FIG. 2) and the cover plate 5. The gear portion 41 of the movable gear 33 includes a large-diameter helical gear 41A meshed with the fourth drive gear 31, and a small-diameter plain gear 41B meshed with the transport drive gear 23.

The side plate 3L and the cover plate 5 each include a slot 51, formed along the circumferential direction of a circle centered at the axial center of the movable gear 33 (FIG. 3 only shows the slot 51 of the cover plate 5). An end portion of the rotary shaft 43 of the movable gear 33 is inserted in the slot 51 of the side plate 3L, and the other end portion is inserted in the slot 51 of the cover plate 5. Thus, the end portions of the rotary shaft 43 are supported rotatably, and also movably along the circumferential direction of the circle centered at the axial center of the movable gear 33. In this embodiment, the side plate 3L exemplifies the second plate in the disclosure, and the cover plate 5 exemplifies the first plate.

Referring to FIG. 4A and FIG. 4B, when the fourth drive gear 31 rotates clockwise, the movable gear 33 moves clockwise along the slot 51, while rotating counterclockwise. The movable gear 33 thus moves until the end portion of the rotary shaft 43 abuts against an end (rear end) of the slot 51 (see FIG. 4A). At this position, the plain gear 41B of the movable gear 33 (see FIG. 3) is meshed with the transport drive gear 23. In other words, the position where the end portion of the rotary shaft 43 of the movable gear 33 abuts against the rear end of the slot 51 corresponds to the normal position.

On the other hand, when the fourth drive gear 31 rotates counterclockwise, the movable gear 33 moves counterclockwise along the slot 51, while rotating counterclockwise. The movable gear 33 thus moves until the end portion of the rotary shaft 43 abuts against the other end (front end) of the slot 51 (see FIG. 4B). At this position, the plain gear 41B of the movable gear 33 is disengaged from the transport drive gear 23. In other words, the position where the end portion of the rotary shaft 43 of the movable gear 33 abuts against the front end of the slot 51 corresponds to the disengaged position.

As shown in FIG. 1 and FIG. 3, in the vicinity of the slot 51 of the cover plate 5, a hook portion 53 formed by cutting away a portion of the side edge of the cover plate 5, and a rectangular opening 55 (see FIG. 1) are located close to each other. On the inner face of the cover plate 5, a boss 57 (see FIG. 3) is formed so as to protrude, between the hook portion 53 and the opening 55.

In general, a helical gear is subjected, depending on the rotation direction, to a force exerted in the axial direction of the rotary shaft (thrust load). In this embodiment, when the movable gear 33 moves to the disengaged position, a force is exerted on the helical gear 41A along the axial direction, from the side plate 3L toward the cover plate 5. Such a force may cause an end portion of the rotary shaft 43 to come off from the slot 51 of the side plate 3L, or make the engagement between the movable gear 33 and the fourth drive gear 31 imperfect. Accordingly, the gear train 13X includes a leaf spring 61 that buffers the movement of the movable gear 33 in the axial direction.

Figure 5:
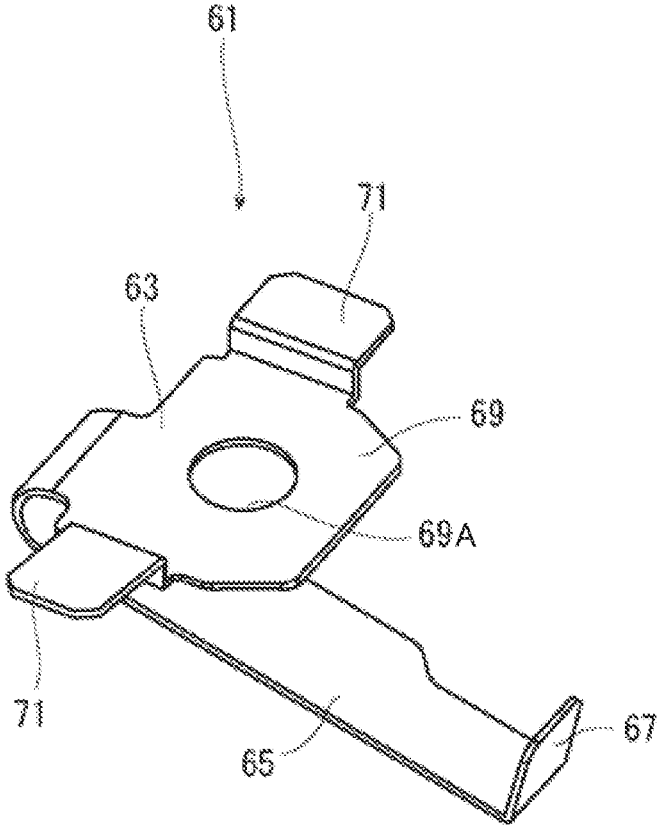
FIG. 5 is a perspective view showing the leaf spring.

Referring also to FIG. 5, in addition to FIG. 3, the leaf spring 61 will be described hereunder. FIG. 5 is a perspective view showing the leaf spring 61.

As shown in FIG. 5, the leaf spring 61 is made from a sheet metal. The leaf spring 61 includes a mounting portion 63 to be attached to the cover plate 5 (see FIG. 3), a pressing portion 65 bent so as to define an acute angle with respect to the mounting portion 63, and a distal end portion 67 bent from the pressing portion 65.

The mounting portion 63 includes a generally rectangular base portion 69, and a pair of hook portions 71 formed on the respective side edges of the base portion 69 opposed to each other. A circular opening 69A is formed in the vicinity of the center of the base portion 69. The pair of hook portions 71 are bent generally at right angle in the same direction, from the respective side edges of the base portion 69 opposed to each other, and further bent generally at right angle in opposite directions to each other. The pressing portion 65 has an elongate plate shape. The pressing portion 65 is arcuately bent generally in 180 degrees in the direction opposite to the bending direction of the pair of hook portions 71, from a portion of another side edge of the base portion 69, and extends further ahead with respect to the base portion 69. Thus, the pressing portion 65 is bent so as to define an acute angle with respect to the mounting portion 63. The pressing portion 65 is wider in the portion on the side of the base portion 69, and narrower in the portion on the side of the distal end portion 67. The distal end portion 67 is bent generally at right angle toward the mounting portion 63, from the tip portion of the pressing portion 65. The leading end of the distal end portion 67 is formed in an arcuate shape. In a free posture of the leaf spring 61, with no compressive force applied thereto, the leading end of the distal end portion 67 does not reach the plane that includes the base portion 69.

The cover plate 5 is located on the downstream side in the direction from the side plate 3L to the cover plate 5, and the side plate 3L is located on the upstream side, in the same direction. As shown in FIG. 3, the leaf spring 61 is attached to the cover plate 5, by fitting the boss 57 of the cover plate 5 in the opening 69A of the base portion 69, and respectively engaging the pair of hook portions 71 with the hook portion 53 and the opening 55 (see FIG. 1) of the cover plate 5. The pressing portion 65 abuts against the helical gear 41A of the gear portion 41, with a predetermined pressure applied in the direction from the cover plate 5 toward the side plate 3L. A clearance C is defined between the leading end of the distal end portion 67 and the cover plate 5. The clearance C is determined so as to keep the end portion of the rotary shaft 43 from coming off from the opening of the side plate 3L, when the movable gear 33 has moved in the direction from the side plate 3L toward the cover plate 5 until the distal end portion 67 abuts against the cover plate 5, in other words so as to keep the end portion of the rotary shaft 43 supported by the side plate 3L. The clearance C may be set, for example, to 0.4 mm.

Figure 6A:
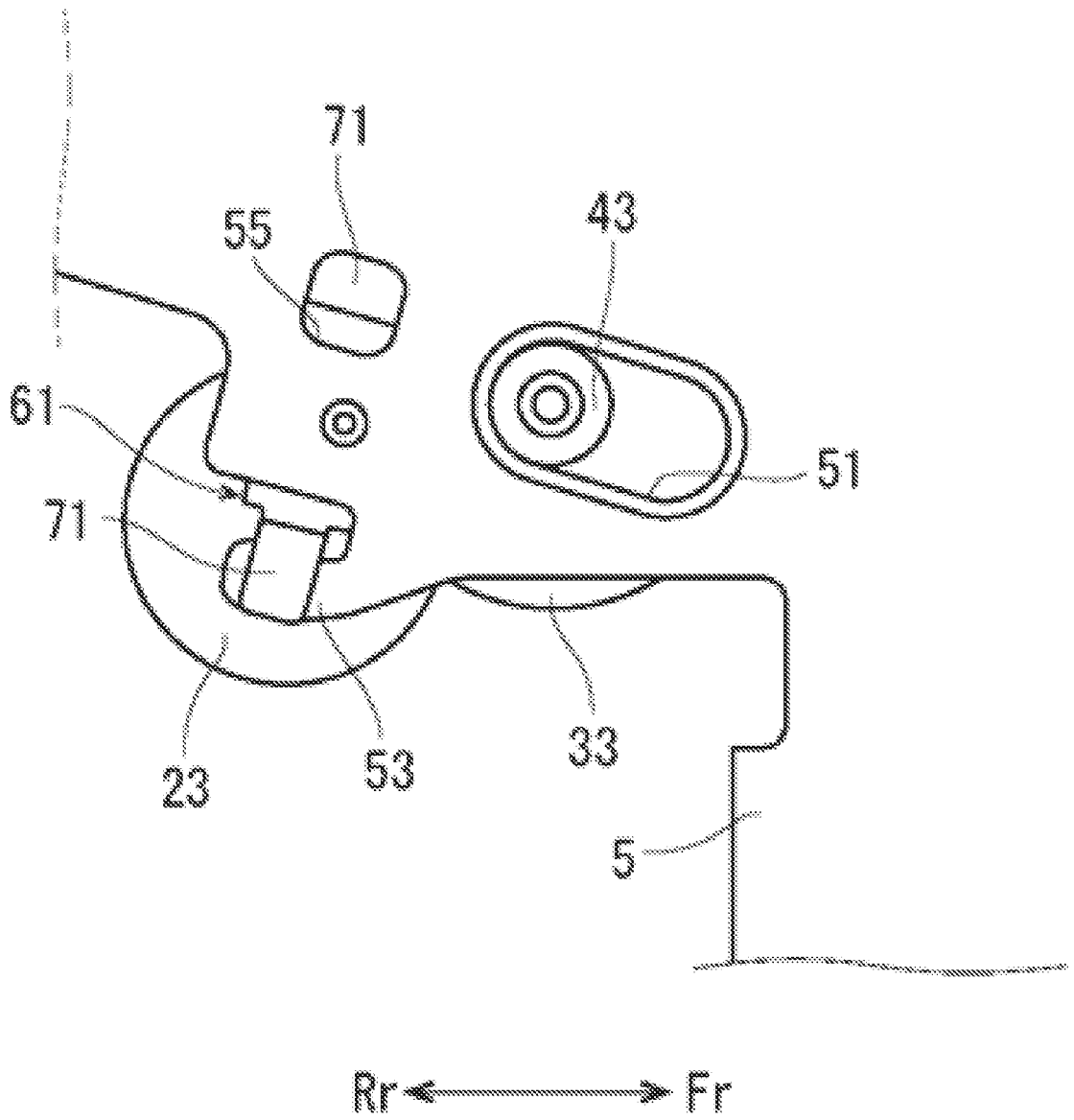
FIG. 6A is a side view of the movable gear and the leaf spring, located at the normal position.
Figure 6B:
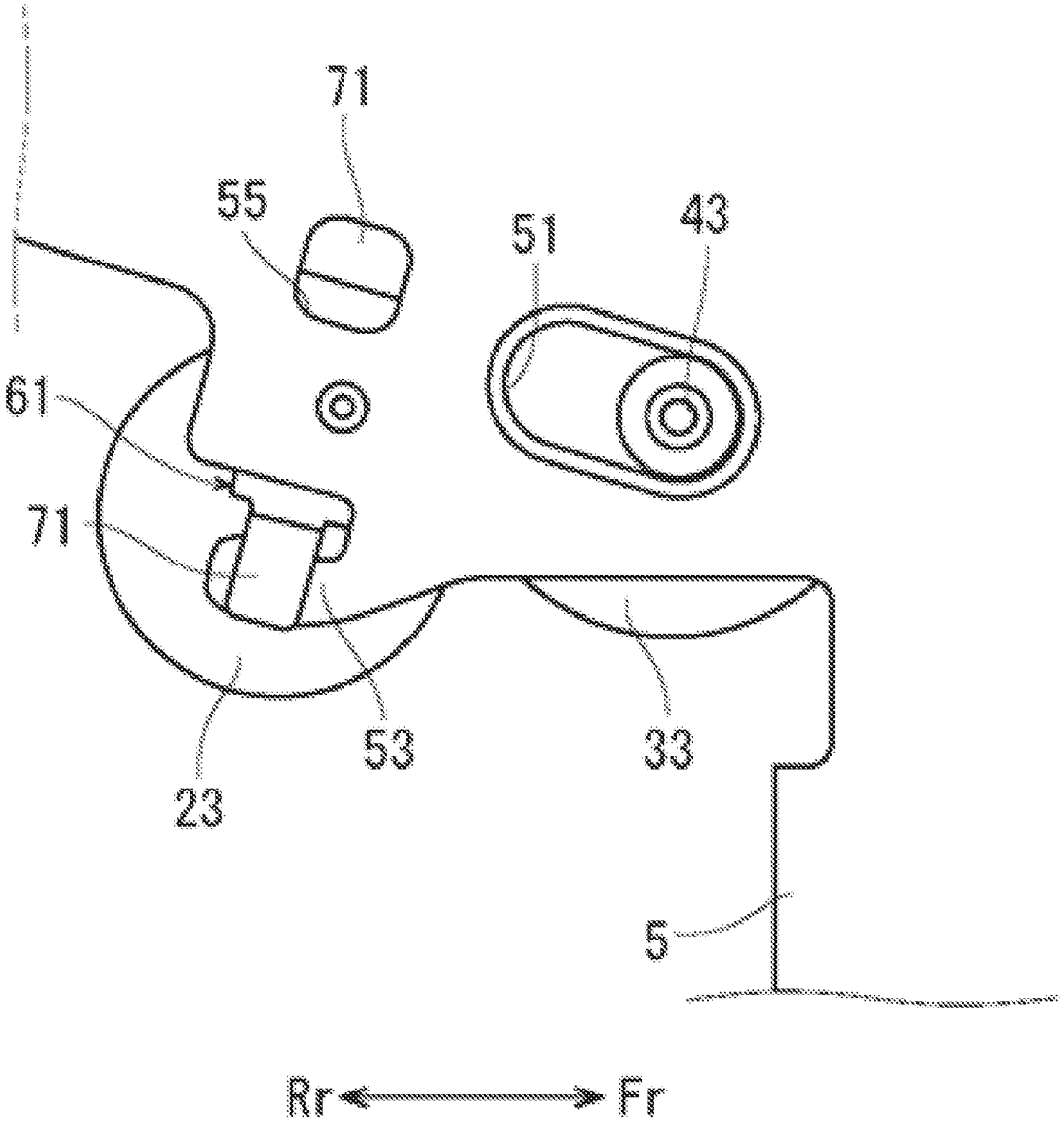
FIG. 6B is a side view of the movable gear and the leaf spring, located at the disengaged position.

The working of the gear train 13X, when a paper jam is fixed in the image forming apparatus 1 configured as above, will be described hereunder, with reference to FIG. 6A and FIG. 6B, in addition to FIG. 2, FIG. 3, FIG. 4A, and FIG. 4B. FIG. 6A and FIG. 6B illustrate the movable gear 33 and the leaf spring 61, before and after the position change.

First, the working of the gear train 13X in the normal operation will be described. When the motor 11 rotates in one direction in the normal operation, the output gear 21 fixed to the output shaft 11A of the motor 11 rotates clockwise in FIG. 2. Then the fourth drive gear 31 rotates clockwise, via the first to third drive gears 25, 27, and 29. The rotation of the fourth drive gear 31 causes the movable gear 33 to move clockwise, while rotating counterclockwise. The movable gear 33 moves until reaching the normal position, and continues to rotate counterclockwise, at the normal position (see FIG. 4A and FIG. 6A). When the movable gear 33 is thus located at the normal position, the rotating force of the motor 11 is transmitted to the transport drive gear 23, so that the transport drive roller 15 is made to rotate and transports the sheet.

When a paper jam occurs, the motor 11 rotates in the reverse direction. Then the fourth drive gear 31 rotates counterclockwise, via the first to the third drive gears 25, 27, and 29. Such rotation of the fourth drive gear 31 causes the movable gear 33 to move counterclockwise, while rotating clockwise. The movable gear 33 moves until reaching the disengaged position, and continues to rotate clockwise (reversely), at the disengaged position (see FIG. 4B and FIG. 6B). When the movable gear 33 is thus located at the disengaged position, the transmission of the rotating force of the motor 11 to the transport drive gear 23 is interrupted.

When the movable gear 33 rotates clockwise as above, the movable gear 33 is subjected to a force exerted along the axial direction, in the direction from the side plate 3L toward the cover plate 5. However, since the pressing portion 65 of the leaf spring 61 is in contact with the gear portion 41, applying a force in the direction from the cover plate 5 toward the side plate 3L as shown in FIG. 3, the movement of the movable gear 33 in the axial direction can be buffered. The movable gear 33 can move until the distal end portion 67 of the leaf spring 61 abuts against the cover plate 5. The movable gear 33 moves from the normal position to the disengaged position, against the pressing force of the leaf spring 61.

Thereafter, the user removes the sheet caught between the transport roller pair. Since the transport drive roller 15 is freely rotatable at this point, the user can remove the sheet from the transport roller pair, without significant difficulty.

Now, the gear train of some of the existing image forming apparatuses includes a helical gear. In this case, when the motor rotates reversely, the helical gear is subjected to a force exerted along the axial direction. This may cause the helical gear to come off or be imperfectly engaged, and therefore a compression spring is employed in the existing image forming apparatuses, to delimit the movement of the helical gear in the axial direction. However, in the case of employing the compression spring, it is necessary to stably support the compression spring, while securing the space for locating the compression spring and also the compression margin. Therefore, the freedom in designing is reduced, and the assembly work becomes complicated.

According to the foregoing embodiment, in contrast, the leaf spring 61 is employed to buffer the movement of the movable gear 33 in the axial direction. Therefore, the space for locating the leaf spring 61 can be reduced, and the assembly work of the gear train can be simplified. To be more detailed, it suffices to fit the opening 69A of the leaf spring 61 around the boss 57 of the cover plate 5, and respectively engage the pair of hook portions 71 of the leaf spring 61, with the opening 55 and the hook portion 53. In addition, an appropriate space can be secured between the movable gear 33 and the cover plate 5, because of the presence of the distal end portion 67 of the leaf spring 61, the deformation of the leaf spring 61 can be prevented, in the assembly work thereof.

Further, a relatively large contact area can be secured between the pressing portion 65 of the leaf spring 61 and the gear portion 41 of the movable gear 33, and therefore the pressing portion 65 can stably remain in contact with the movable gear 33, while the movable gear 33 is moving. Accordingly, the leaf spring 61 can stably buffer the movement of the movable gear 33. Consequently, though the movable gear 33 is made to rotate reversely when moving from the normal position to the disengaged position, the rotary shaft 43 of the movable gear 33 can be prevented from coming off from the side plate 3L, and the helical gear 41A of the movable gear 33 can be prevented from becoming imperfectly engaged with the fourth drive gear 31.

Further, the movable gear 33 is located between the transport drive gear 23, and the fourth drive gear 31 located upstream of the transport drive gear 23 in the transmission direction of the rotating force. Such a location of the movable gear 33 minimizes the number of parts of the gear train.

In the foregoing embodiment, the transport drive roller 15 of the transport roller pair exemplifies the transport roller in the disclosure. However, the transport roller is not limited to the transport drive roller 15. The transport roller may be any of the drive rollers that are driven to rotate, among the roller pairs that transport the sheet by rotating. For example, the transport roller may be whichever of the heat roller and the pressure roller of the fixing device that is driven to rotate, or one of the resist roller pair that is driven to rotate.

Although the disclosure has been described on the basis of the foregoing embodiment, the disclosure is not limited thereto. Those skilled in the art may modify the foregoing embodiment, within the scope and the spirit of the disclosure.

While the present disclosure has been described in detail with reference to the embodiments thereof, it would be apparent to those skilled in the art the various changes and modifications may be made therein within the scope defined by the appended claims.

What is claimed is:

1. A sheet transport device comprising:

a transport roller that transports a sheet;

a drive source; and a gear train that transmits rotating force from the drive source to the transport roller, the gear train including:

a movable gear configured to move between a normal position where transmission of the rotating force to the transport roller is enabled, and a disengaged position where the transmission of the rotating force to the transport roller is interrupted, and also to move in an axial direction, and including a helical gear that generates force to axially move in one direction, when the movable gear moves from the normal position to the disengaged position; and a leaf spring that buffers the movement of the movable gear in the one direction.

2. The sheet transport device according to claim 1, further comprising a first plate and a second plate, supporting respective end portions of a rotary shaft of the movable gear, rotatably and movably between the normal position and the disengaged position, wherein the first plate is located on a downstream side in the one direction, and the second plate is located on an upstream side in the one direction, the leaf spring includes:

a mounting portion to be fixed to the first plate;

a pressing portion bent so as to define an acute angle with respect to the mounting portion, and to contact the helical gear toward the other side in the axial direction; and a distal end portion bent to a side of the mounting portion from a tip portion of the pressing portion, and a predetermined clearance is defined between the distal end portion and the first plate.

3. The sheet transport device according to claim 2, wherein the predetermined clearance is set to equal to or shorter than a distance that keeps an end portion of the rotary shaft of the movable gear supported by the second plate, when the movable gear has moved in the one direction until the distal end portion abuts against the first plate.

4. The sheet transport device according to claim 1, further comprising a drive gear located upstream side of the transport roller in a transmission direction of the rotating force, wherein the movable gear is located between the transport roller and the drive gear.

5. An image forming apparatus comprising:

the sheet transport device according to claim 1; and an image forming device that forms an image on the sheet.

* * * * *